US006223895B1

(12) United States Patent
Bowen et al.

(10) Patent No.: US 6,223,895 B1
(45) Date of Patent: May 1, 2001

(54) TWO-PACK KIT FOR PACKAGING MAKE-YOUR-OWN CIGARETTES

(75) Inventors: Larry Bowen, Orangeville; Norman Cohen, Scarborough, both of (CA)

(73) Assignee: Rothmans, Benson & Hedges Inc., Ontario (CA)

( * ) Notice: Subject to any disclaimer, the term of this patent is extended or adjusted under 35 U.S.C. 154(b) by 0 days.

(21) Appl. No.: 09/404,372

(22) Filed: Sep. 24, 1999

(30) Foreign Application Priority Data

Nov. 10, 1998 (CA) ..... 2253134

(51) Int. Cl.[7] ..... B65D 69/00
(52) U.S. Cl. ..... 206/236; 206/256
(58) Field of Search ..... 206/236, 242, 206/265, 268, 271, 273, 497, 256; 131/329, 360, 364

(56) References Cited

U.S. PATENT DOCUMENTS

| | | | | |
|---|---|---|---|---|
| 2,984,340 | | 5/1961 | Carmichael . | |
| 3,007,623 | | 11/1961 | Clemens . | |
| 3,051,305 | | 8/1962 | Houle . | |
| 3,148,768 | * | 9/1964 | Gatto | 206/256 |
| 3,226,010 | | 12/1965 | Rogers, Jr. . | |
| 3,752,308 | * | 8/1973 | Begemann | 206/256 |
| 3,809,227 | | 5/1974 | Begemann . | |
| 4,669,611 | | 6/1987 | Flaherty . | |
| 4,784,261 | | 11/1988 | Kutchin . | |
| 4,928,817 | | 5/1990 | Focke . | |
| 5,031,645 | * | 7/1991 | Kim | 206/236 |
| 5,178,269 | * | 1/1993 | Evers | 206/256 |
| 5,180,055 | * | 1/1993 | Chance et al. | 206/256 |
| 5,201,413 | * | 4/1993 | DeBlasio et al. | 206/256 |
| 5,465,738 | * | 11/1995 | Rowland | 206/242 |
| 5,467,872 | | 11/1995 | Minarelli et al. . | |
| 5,794,771 | * | 8/1998 | Krawec et al. | 206/236 |

FOREIGN PATENT DOCUMENTS

| | | |
|---|---|---|
| 487165 | 10/1952 | (CA) . |
| 604546 | 9/1960 | (CA) . |
| 711109 | 6/1965 | (CA) . |
| 1270468 | 6/1990 | (CA) . |
| 2184035 | 2/1998 | (CA) . |
| 2265185 | 2/1998 | (CA) . |
| 2011254 | 5/1998 | (CA) . |
| 2192760 | 6/1999 | (CA) . |

* cited by examiner

*Primary Examiner*—Luan K. Bui
(74) *Attorney, Agent, or Firm*—Banner & Witcoff, Ltd.

(57) ABSTRACT

In accordance with the present invention there is provided a novel cigarette packaging system for "making your own" smokeable cigarettes. The kit is easily opened and allows a smoker to assemble a smokeable cigarette quickly without requiring great effort. The kit is inexpensive, convenient to use and also convenient to carry and store as its compact size is such that it fits in a person's hand, a shirt or coat pocket as well as in a ladies bag or purse. The kit is also advantageous because it is less expensive than tailor made cigarettes, yet is not that much wider than a standard, typical package of cigarettes. The construction of the kit, is such that it keeps the unsmokeable tobacco elements in a separate compartment which serves to help maintain the freshness of the tobacco.

3 Claims, 6 Drawing Sheets

TWO-PACK KIT FOR PACKAGING MAKE-YOUR-OWN CIGARETTES

FIELD OF THE INVENTION

This invention relates to cigarette packages and more specifically, the invention is directed to a two-pack cigarette kit packaging system for making your own cigarettes.

BACKGROUND OF THE INVENTION

Cigarettes are normally sold as complete tailor made cigarettes which can be smoked without further assembly or processing by the consumer. There are, however, several advantages including financial for smokers to assemble their own cigarettes.

There are a variety of available forms of inherently-unsmokeable cigarettes which can be assembled in different manners such as for example described in Canadian Patent No. 2,011,254. However, up until now, such cigarettes have not been available in a convenient, compact and easy to use kit that is pocket sized and provides for the rapid and simple assembly of smokeable cigarettes.

Several different types of cigarette packaging have been developed over the years. For example, Canadian Patent 487,165 discloses a packaging means for cigarettes in which several individual packages of cigarettes are held together with an encircling band and retained together with an adhesive strip made of cellulose tape. Canadian Patent 604,546 is directed to an interconnected container unit for retaining cigarettes which is essentially a foldable unit. The unit is made of a flat single sheet of material having opposed ends which is folded into several sections and held together with an adhesive.

Canadian Patent 711,109 is directed to a multi-compartment cigarette package where each compartment contains six cigarettes. The package itself is approximately the size of a conventional package of cigarettes. Each compartment has an inner foil wrapping and a sealed cellophane wrapper enclosing each separable compartment with pull tape securing each individual compartments together.

U.S. Pat. No. 2,984,340 discloses a cigarette package for holding short cigarettes. The package comprises two individual packages each having a flip top lid which are held together by a revenue stamp and outer cellophane wrapping.

U.S. Pat. No. 3,007,623 discloses a dual cigarette pack for packaging two different kinds of cigarettes in a single container. One compartment may contain filter tipped cigarettes and the other plain cigarettes. The dual pack has an outer sealing wrapper (cellophane) which is removable in such a manner that one portion of the pack is kept closed while the other is in use. This is a single package with two separate compartments.

U.S. Pat. No. 3,051,305 discloses a cigarette display carton comprising a cardboard to form a bottom panel into which several cigarette packages are stood upright thereon. Side panels are also provided. A transparent film is wrapped tightly around the plurality of packages.

U.S. Pat. No. 3,226,010 discloses a cigarette packaging system for dual compartment cigarette packages in which both compartments are made of a common paper wrapper and the entire system enclosed in cellophane.

U.S. Pat. No. 3,809,227 discloses a cigarette packaging system in which individual packages are wrapped in an aligned single row or double row. A frangible strip is provided to open the wrapper or alternatively the frangible strip may be used to connect packages together.

U.S. Pat. No. 4,669,611 discloses a package group comprising two individual packages having a pricing bar code on one side and are fastened together in a stacked relationship by a wrap around adhesive band of a transparent material.

U.S. Pat. No. 4,928,817 discloses packaging for a plurality of small cigarette packs in which several cigarette packs are combined to form small groups. Each group of cigarette packs is held together by means of a wrapping consisting of paper, cardboard or film material open on at least one side such that at least the bottom walls of the cigarette packs are exposed or accessible. The cigarette packs are connected to one another and to the wrapping by an adhesively bonded film strip.

U.S. Pat. No. 5,467,872 discloses a rigid, hinged-lid packet for cigarettes which has an intermediate portion closed at opposite ends by two hinged lids and housing two opposite orderly groups of cigarettes. Each group of cigarettes are accessible by opening a respective lid. The intermediate portion also houses at least one substantially rigid reinforcing structure having a number of sleeves engaged by respective cigarettes.

It is evident that there are several different types of cigarette packaging systems for complete tailor made ready to smoke cigarettes. However, there are no cigarette packaging systems specifically for "make-your-own" cigarettes that can be conveniently assembled from a sufficiently compact kit to be portable in a pocket or purse and provide the necessary elements in a compact kit.

There is therefore a need to develop a simple and cost efficient cigarette kit packaging system designed specifically for "make-your-own" cigarettes.

SUMMARY OF THE INVENTION

In accordance with the present invention there is provided a novel cigarette packaging system for "making your own" smokeable cigarettes. The kit is easily opened and allows a smoker to assemble a smokeable cigarette quickly without requiring great effort. The kit is inexpensive, convenient to use and also convenient to carry and store as its compact size is such that it fits in a person's hand, a shirt or coat pocket as well as in a ladies bag or purse. The kit is also advantageous because it is less expensive than tailor made cigarettes, yet is not that much wider than a standard, typical package of cigarettes. The construction of the kit, is such that it keeps the unsmokeable tobacco elements in a separate compartment which serves to help maintain the freshness of the tobacco.

According to an aspect of the present invention is a two-pack cigarette kit packaging system comprising;

- a first package containing a plurality of unsmokeable tobacco elements;
- a second package containing a plurality of elements to render said tobacco elements smokeable, the first and second packages being independently openable; and
- a removable outer wrapper for enclosing and holding together said first and said second packages in a stacked superimposed relationship.

The packaging kit of the present invention can be used to package various different types of "make-your-own" cigarettes. The kit can also be packaged in multiples to provide a multitude of kits in the form of a carton.

In accordance with another embodiment of the invention, there is provided a method for packaging "make-your-own" cigarettes, the method comprising;

- providing a plurality of unsmokeable tobacco elements in a first openable package;

providing a plurality of elements for rendering the tobacco elements smokeable in a second openable package; and placing the first and second packages in a stacked and superimposed relationship and placing a removable outer wrapper over both first and second packages to hold the packages together.

Preferably, the first openable package has means to indicate that a tobacco duty has been paid. Also, it is preferred that the first package containing tobacco is separately covered with a removable outer wrapper to help keep the tobacco contained therein fresher.

BRIEF DESCRIPTION OF THE DRAWINGS

A detailed description of the preferred embodiments are provided herein below with reference to the following drawings in which.

Figure 1:
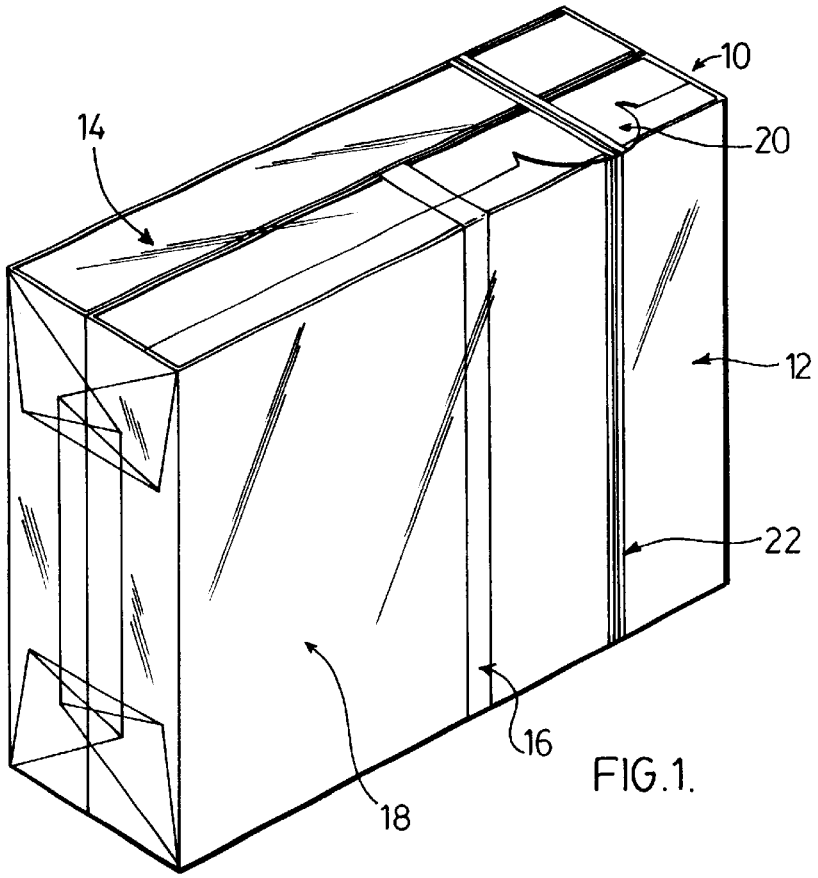
FIG. 1 is a front perspective view of the two-pack cigarette kit packaging system in accordance with a preferred embodiment of the invention.

In the drawings, preferred embodiments of the invention are illustrated by way of example. It is to be expressly understood that the description and drawings are only for the purpose of illustration and as an aid to understanding, and are not intended as a definition of the limits of the invention.

DETAILED DESCRIPTION OF THE PREFERRED EMBODIMENTS

Figure 2:
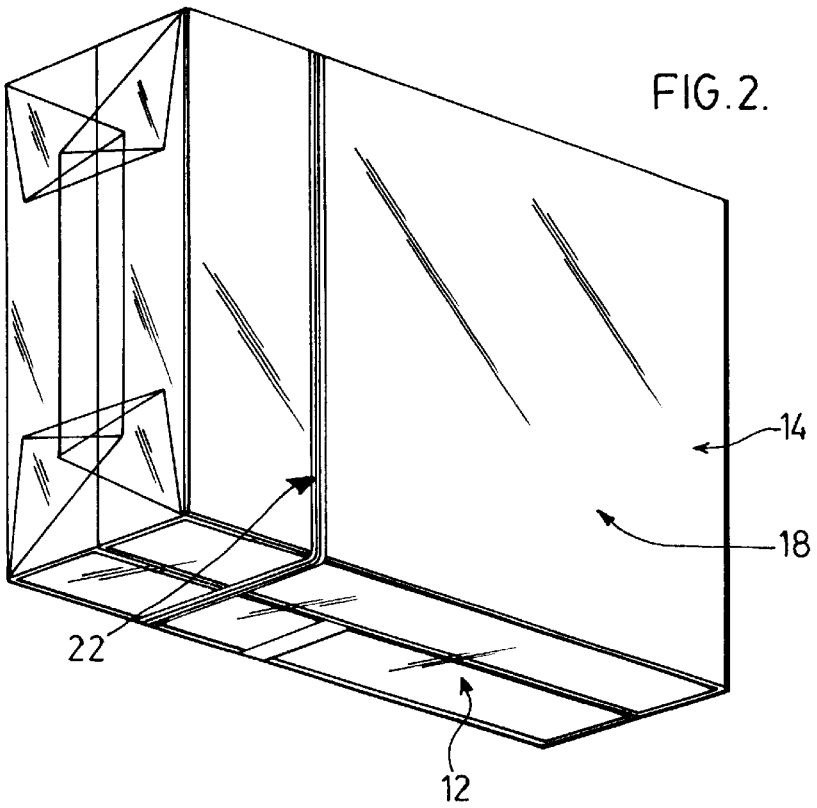
FIG. 2 is a rear perspective view of the packaging system in accordance with the preferred embodiment.

Referring to FIG. 1 and 2 there is illustrated a two-pack cigarette kit packaging system generally indicated 10. The kit preferably comprises two identical individual packages 12, 14 which are stacked and registered in a superimposed relationship. It is understood that the kit may comprise different size packages as well. The first package 12 has a frangible government duty strip 16 and preferably an overwrap to maintain freshness of the contained unsmokeable tobacco elements. The second package 14 contains non-perishable elements for use with the unsmokeable tobacco elements to render them smokeable. The second package does not have to be separately wrapped. Both packages 12, 14 are covered in a removable outer cellophane wrapper 18 which has a pull tab 20 and frangible strip 22 to effect removal of the wrapper 18.

While the packages 12, 14 are shown to be of a large regular size in terms of cigarette packaging, it is appreciated that the packages can be made to be king size in terms of cigarette packaging as well. Also, the packages can vary in size somewhat from each other so long as the entire kit remains compact enough to be placed in a purse or a pocket.

Cellophane or polypropylene are the preferred wrapping materials used to form the removable outer wrapper for the packaging system, however, it is understood that any suitable wrapper material which is transparent, translucent or opaque can be used for this purpose so long as it can be readily opened by hand.

Figure 3:
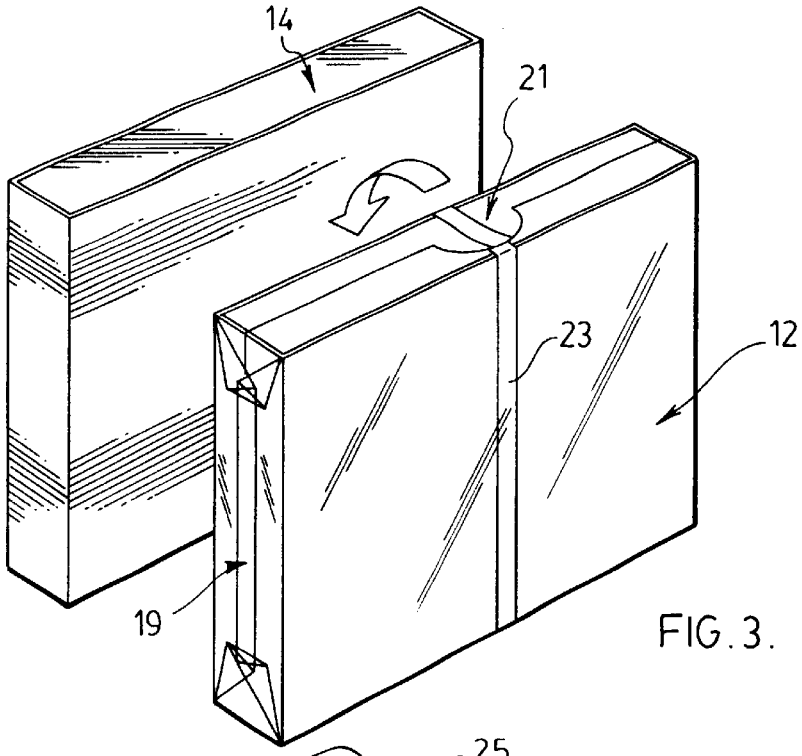
FIG. 3 is a front perspective view of the packaging system showing the individual packages.
Figure 4:
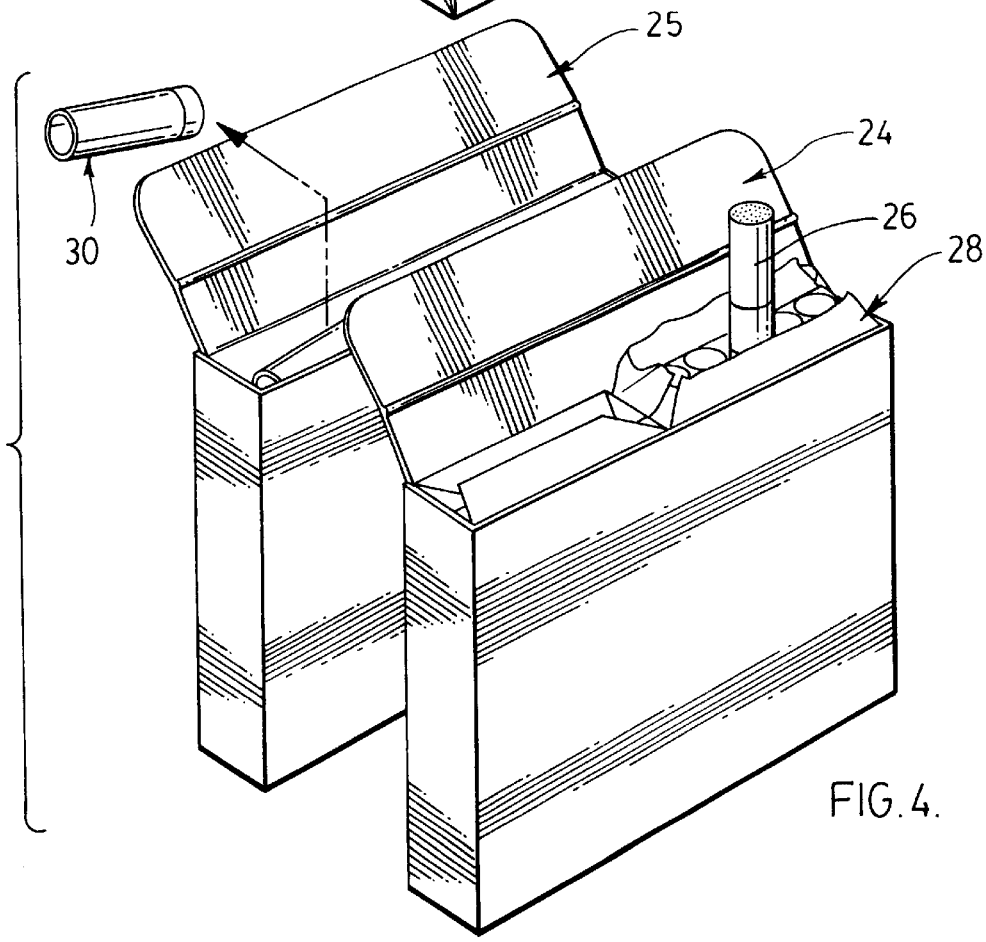
FIG. 4 is a front perspective view of the packaging system showing the individual packages of FIG. 3 in the open position.
Figure 5A:
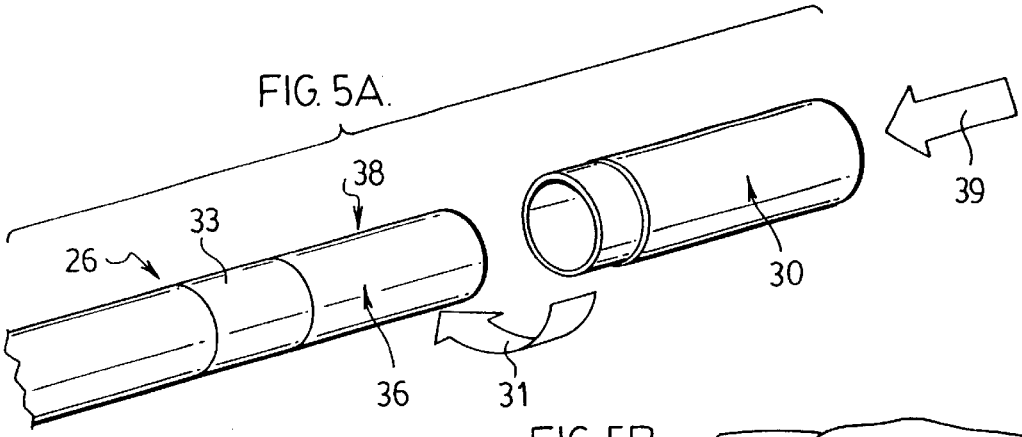
FIGS. 5A through 5D show a first embodiment of a "make-your-own" cigarette which can be used in conjunction with the packaging of the present invention.
Figure 5B:
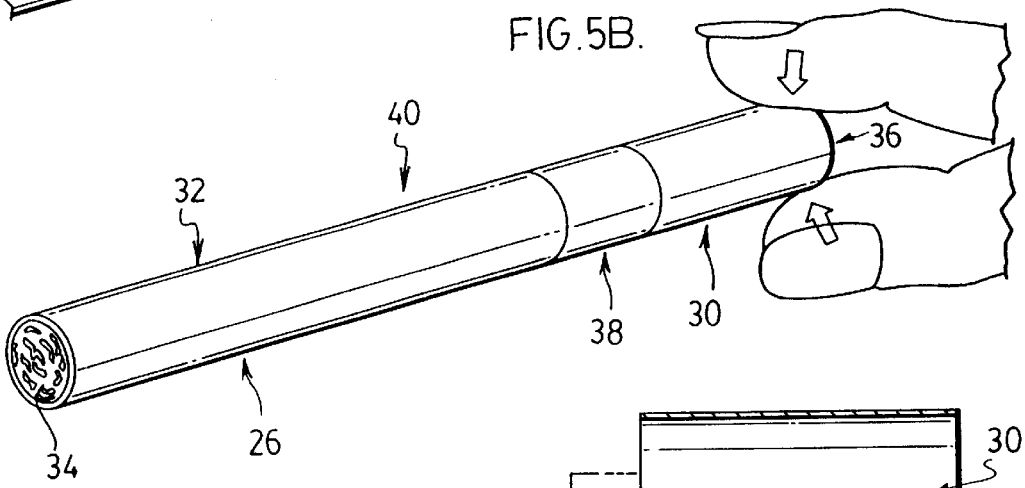
Figure 5C:
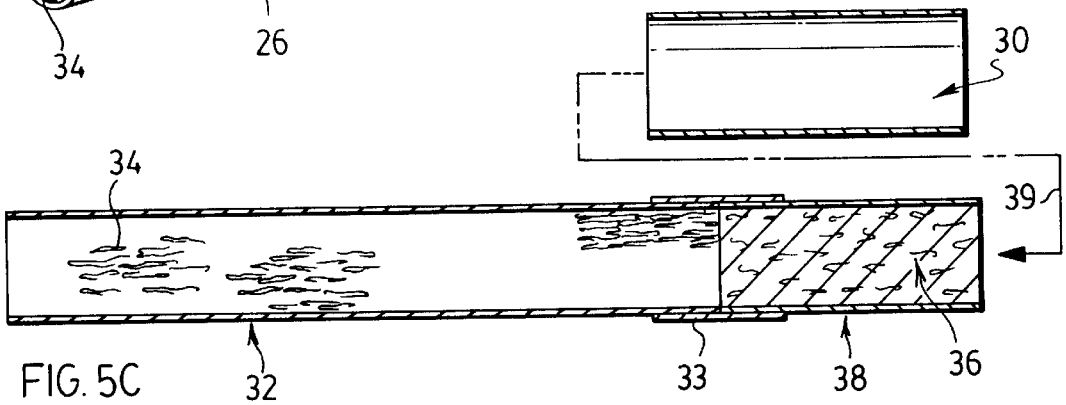
Figure 5D:
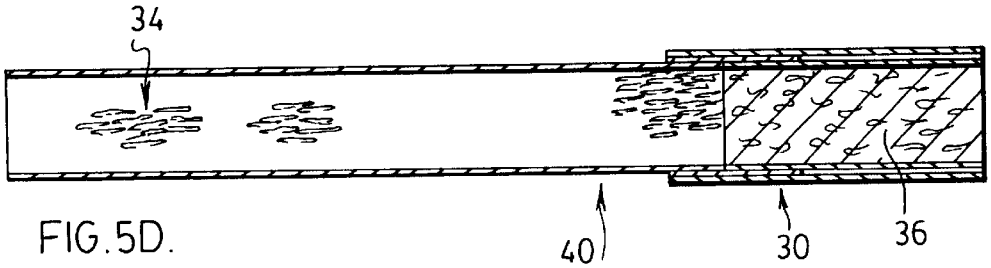

FIGS. 3 and 4 illustrate the use of the two-pack cigarette kit of the present invention. The outer wrapping 18 is removed by pulling on the pull tab 20 and the tear strip 22. This separates the two packages 12, 14 each of which are separately openable. The first package 12 is covered with its own wrapper 19 having a separate pull tab 21 to effect opening of the frangible duty strip 23. To open the first package 12 containing the tobacco, the wrapper which may be cellophane 19 is removed by pulling on the pull tab 21 of the frangible duty strip 23. This acts to also remove the duty strip 16 from around the first package. It is also understood that the first package 12 may be closed with a frangible duty strip and no overwrap 19 in view of the outer overwrap 18 for the two pack system 10. Both the first package 12 and the second package 14 have standard shell and slide lids 24 and 25 located on the top portion of each package which is openable to reveal the contents of the packages.

As shown in FIG. 4, the first package 12 containing unsmokeable cigarette elements 26 has an inner foil wrapping 28 to maintain the freshness of the tobacco contained within the elements 26. The second package 14 contains filter sleeves 30 as the necessary elements for application to the unsmokeable cigarette elements to render them smokeable. The second package does not require an inner foil wrapper. It is preferred that foil wrapping always be used to maintain the freshness of the tobacco. The additional cellophane wrapping on the first package also helps to maintain kit freshness.

The two-pack cigarette kit packaging system can be used with different embodiments of "make-your-own" cigarettes. In one such embodiment shown in FIGS. 4 and 5A through 5D, a smokeable cigarette is made by combining an unsmokeable cigarette element 26 located within the first package 12 with a filter sleeve 30 located in the second package 14 of the kit. The unsmokeable cigarette element 26 comprises an outer cigarette wrapper paper 32 enclosing a tobacco rod 34 and a filter plug 36 connected at one end by tipping paper 33. The filter plug 36 is surrounded by a highly porous paper material 38 such that the cigarette element 26 is not smokeable. The filter sleeve 30 is made of a substantially non-porous paper material. The filter sleeve fitted to the unsmokeable cigarette by rotating in direction of arrow 37 and slide over the porous filter portion of the unsmokeable cigarette element in the direction of arrow 39. The resultant cigarette 40 is thus rendered smokeable.

Figure 6A:
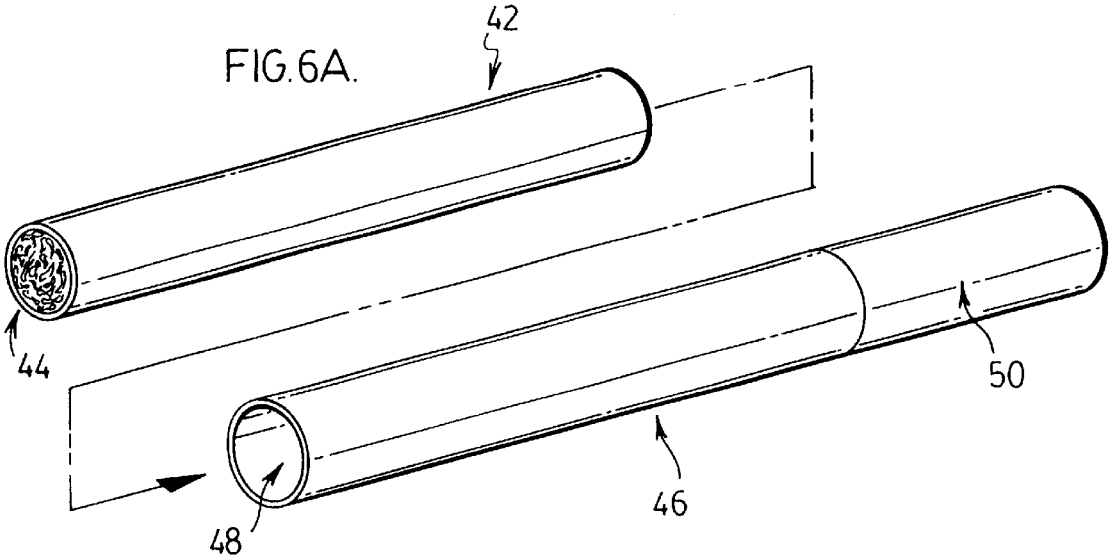
FIGS. 6A through 6C show a second embodiment of a "make-your-own" cigarette which can be used in conjunction with the packaging of the present invention.
Figure 6B:
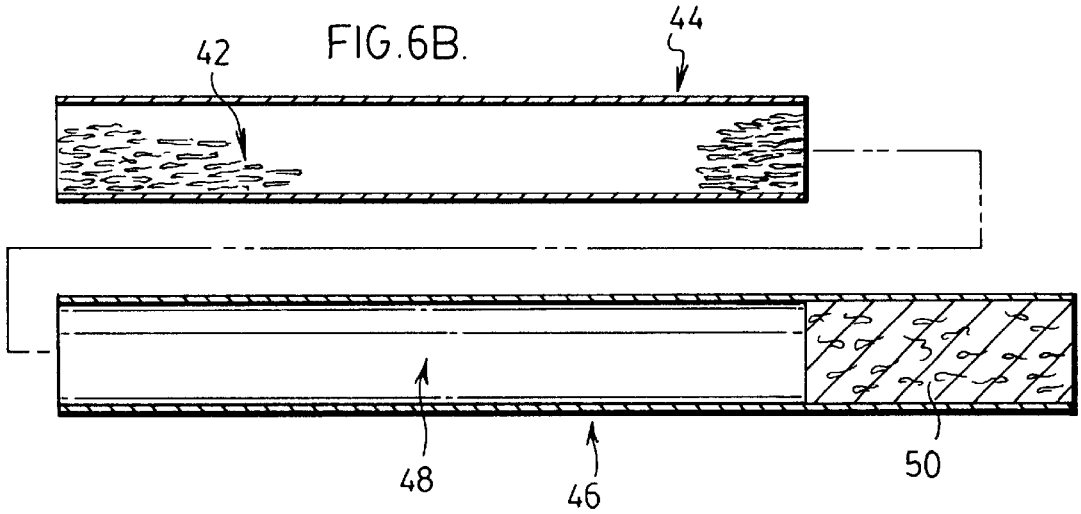
Figure 6C:
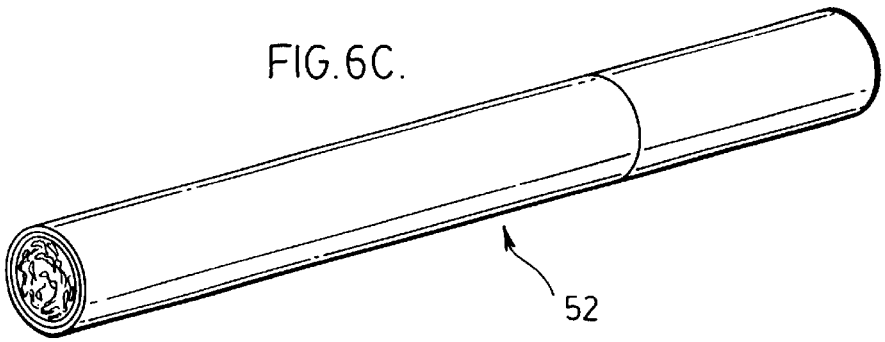
Figure 7:
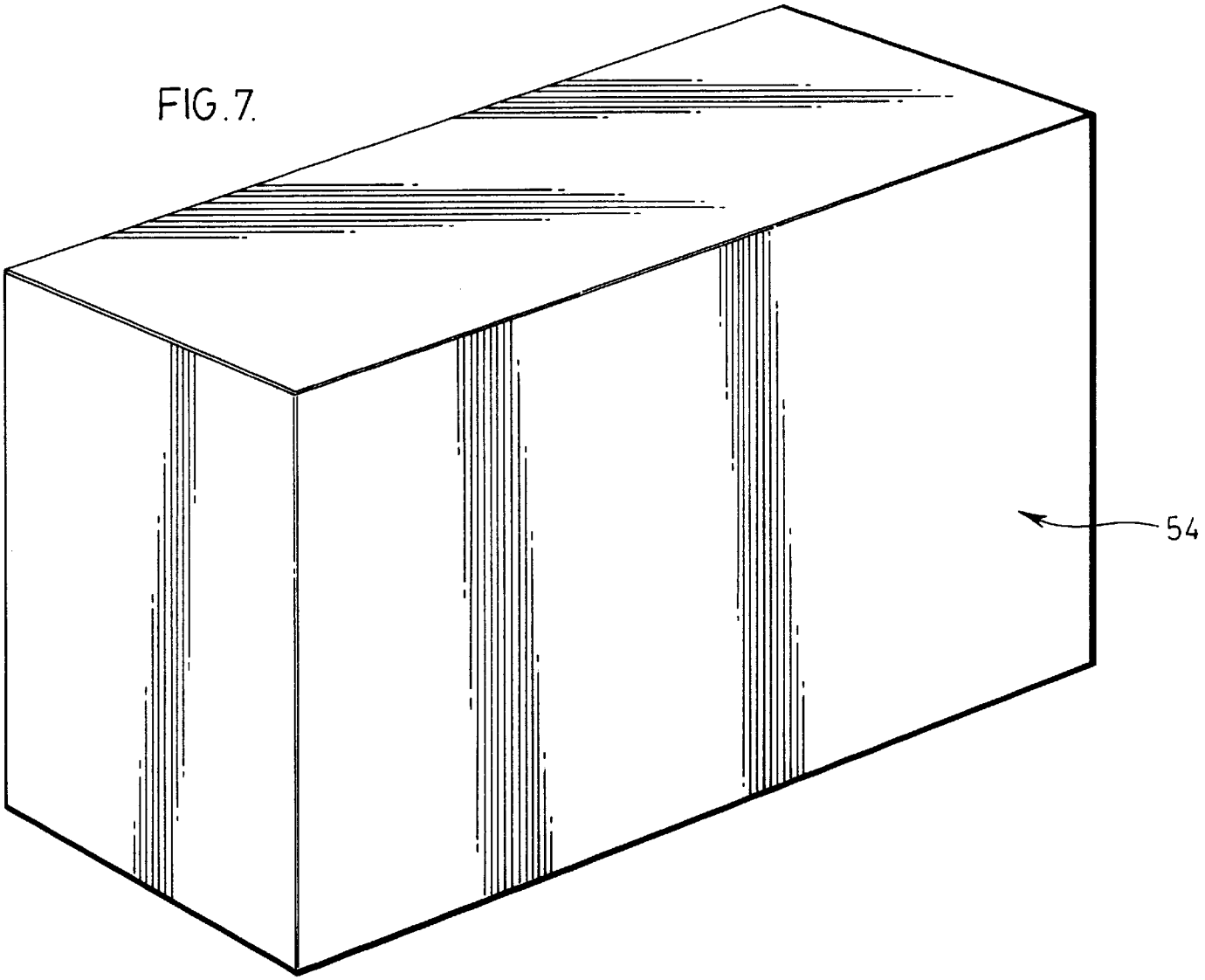
FIG. 7 is a front perspective view of a carton containing multiples of the packaging system of the present invention.

In a second embodiment shown in FIGS. 6A through 6C, a smokeable cigarette is made by combining an unsmokeable tobacco stick 42 which is encased in a highly porous paper material 44 with a cigarette paper sleeve 46 which has a substantially large recess 48 along most of its length but which has at one end, a filter plug 50 inserted therein. The tobacco stick is simply inserted into the recess 48 of the cigarette paper sleeve and again, the resultant cigarette 52 is now smokeable. In this embodiment, the unsmokeable tobacco sticks 42 are placed in the first package 12 of the kit contained within an inner foil wrapper 28. The cigarette paper sleeve 46 would be placed in the second package 14 of the kit and both packages are then stacked and covered and sealed together with a removable outer wrapper.

Figure 8:
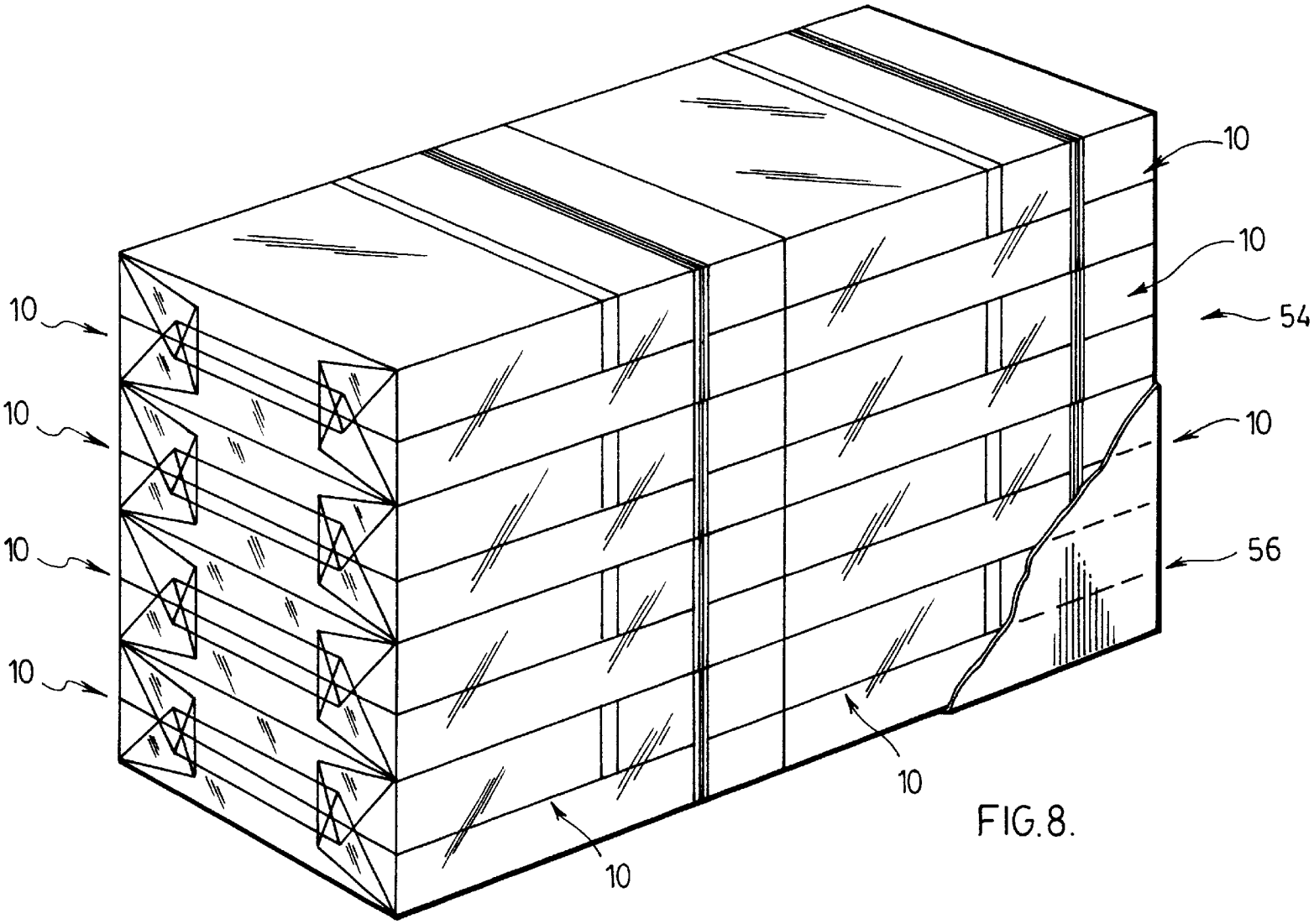
FIG. 8 is a front perspective partially broken away view of the carton of FIG. 7 illustrating multiples of the kits being packaged together.

As seen in FIGS. 8 and 9, the two-pack cigarette kit packaging system 10 of the present invention can be packaged in multiples to provide a multitude of kits 10 in the form of a carton 54. The carton is enclosed within a removable paper or foil packaging 56. Although, not seen in these Figures, such packaging is also provided with a pull tab and frangible strip. As best seen in FIG. 8, the carton 54 comprises the usual eight or ten kits 10 stacked in two adjacent bundles of four superimposed kits.

In summary, the present invention provides a two-pack cigarette kit packaging system for use with different types of "make-your-own" cigarettes. The kit provides an easy and fast method for making smokeable cigarettes which is less-expensive to purchase than tailor made cigarettes. The kit is also compact and convenient to carry in a pocket or a purse.

Although preferred embodiments have been described herein in detail, it is understood by those skilled in the art that variations may be made thereto without departing from the scope of the invention or the spirit of the appended claims.

What is claimed is:

1. A two-pack cigarette kit packaging system comprising:

a first package containing a plurality of unsmokeable tobacco elements, said package being enclosed in a removable overwrap having a frangible duty strip incorporated therein, said duty strip indicating a duty has been paid;

a second package containing a plurality of elements to render said tobacco elements smokeable, said first and second packages being independently openable;

a removable outer wrapper for enclosing and holding together said first and said second packages.

2. The system of claim 1, wherein said removable overwrap is made of a transparent material and has a pull tab to effect the removal of said frangible duty strip and said overwrap.

3. The system of claim 2, wherein said transparent material is cellophane or polypropylene.

* * * * *